US007156436B2

(12) United States Patent
Nguyen

(10) Patent No.: US 7,156,436 B2
(45) Date of Patent: Jan. 2, 2007

(54) CLAMPING DEVICE HAVING AN ACTUATING CARRIAGE WHICH MOVES A MOVABLE JAW TOWARD A STATIONARY JAW

(75) Inventor: Nhon Hau Nguyen, Chester Hill (AU)

(73) Assignee: Abaco Machines (Australasia) Pty Ltd, Fairfield (AU)

( * ) Notice: Subject to any disclaimer, the term of this patent is extended or adjusted under 35 U.S.C. 154(b) by 0 days.

(21) Appl. No.: 11/074,317

(22) Filed: Mar. 7, 2005

(65) Prior Publication Data

US 2006/0197350 A1 Sep. 7, 2006

(51) Int. Cl.
*B66C 1/48* (2006.01)

(52) U.S. Cl. ..... 294/102.1; 294/103.1; 294/901

(58) Field of Classification Search ..... 294/102.1, 294/103.1, 16, 63.1, 96, 101, 110.2, 114, 294/901
See application file for complete search history.

(56) References Cited

U.S. PATENT DOCUMENTS 1,121,130 A * 12/1914 Rafferty ..... 294/103.1

(Continued)

FOREIGN PATENT DOCUMENTS

DE 256 116 A1 4/1988

(Continued)

*Primary Examiner*—Eileen D. Lillis
*Assistant Examiner*—Paul T. Chin
(74) *Attorney, Agent, or Firm*—Shewchuk IP Services, LLC; Jeffrey D. Shewchuk

(57) ABSTRACT

Camping device suitable for lifting and handling of sheet like-objects, having a rigid frame configured to straddle an edge region of sheet-like objects, the frame including a stationary jaw and a frame housing defining a gap between them in which the sheet-like object may be received, the stationary jaw providing a first clamping surface, a movable jaw supported at the frame within the gap for movement towards and away from the stationary jaw, the movable jaw providing a second clamping surface, and an actuating carriage arranged to transmit a clamping force, the carriage being located between the movable jaw and frame housing for reciprocating movement along a longitudinal axis of the device on actuator tracks present at the movable jaw and frame housing, at least a portion of one of the actuator tracks having an inclined portion devised to bias the movable jaw towards the stationary jaw as the actuator carriage is caused by the clamping force to be displaced along the inclined portion, whereby the respective clamping surfaces are brought in contact with opposite faces of the sheet-like object when received within the frame and frictionally clamp same against displacement, characterized in that the movable jaw is supported at and mounted to the frame by at least one linkage arm which is articulated or pivoted at the movable jaw and near the upper end of the frame, respectively.

15 Claims, 4 Drawing Sheets

U.S. PATENT DOCUMENTS

| | | | | | |
|---|---|---|---|---|---|
| 1,312,926 | A | * | 8/1919 | Sherman | 294/103.1 |
| 1,976,848 | A | * | 10/1934 | Ham | 294/103.1 |
| 2,387,408 | A | | 10/1945 | Pertuit | |
| 2,550,424 | A | | 4/1951 | Penn | |
| 2,559,223 | A | | 7/1951 | Murray | |
| 2,569,966 | A | | 10/1951 | Arrigoni | |
| 3,008,749 | A | | 11/1961 | Gowan | |
| 3,101,956 | A | | 8/1963 | Muller | |
| 3,197,250 | A | | 7/1965 | Trotta et al. | |
| 3,244,291 | A | | 4/1966 | Dexter | |
| 3,292,964 | A | | 12/1966 | Albert | |
| 3,524,670 | A | | 8/1970 | Ilich | |
| 3,851,358 | A | | 12/1974 | Janosko | |
| 3,926,468 | A | | 12/1975 | Kondo | |
| 4,243,257 | A | * | 1/1981 | Shackleford | 294/103.1 |
| 5,893,595 | A | | 4/1999 | Corbett | |
| 6,652,016 | B1 | * | 11/2003 | Sbabo et al. | 294/103.1 |
| 2006/0202496 | A1 | * | 9/2006 | Davis | 294/102.1 |

FOREIGN PATENT DOCUMENTS

| | | | |
|---|---|---|---|
| DE | 19923788 | * | 12/2000 |
| FR | 1435976 | | 3/1966 |
| JP | 07-277669 | * | 10/1995 |
| SU | 1207983 | | 1/1986 |
| WO | WO 03/057613 A1 | * | 7/2003 |

* cited by examiner

CLAMPING DEVICE HAVING AN ACTUATING CARRIAGE WHICH MOVES A MOVABLE JAW TOWARD A STATIONARY JAW

FIELD OF THE INVENTION

The present invention relates to clamping devices that may find use in hoisting and handling heavy slab, panel or sheet materials such as stone, masonry, concrete, marble, metal and the like materials. The invention has been conceived as an improvement for lifting clamps of the type having a rigid frame having a stationary jaw plate that provides a first clamping surface, a movable jaw plate that provides a second clamping surface and is supported at the frame for movement towards and away from the stationary jaw plate, and an actuating mechanism to bias the movable jaw plate towards the stationary jaw plate whereby the respective clamping surfaces engage onto opposite faces of the sheet material and frictionally clamp same against displacement within the frame for hoisting.

BACKGROUND OF THE INVENTION

Heavy slabs and sheets of material are usually stored and stacked upright-standing. Handling of this type of materials often entails use of lifting clamps that grip the sheet (hereinafter used generically to also encompass slabs and other planar objects) at its upper edge for hoisting. Consequently, it is convenient in the following description to use reference terminology such as 'vertical', 'horizontal', 'upper', 'lower', 'inclined' and similar when describing operation, components and relative location of components or parts of such clamping devices. Bearing in mind that these devices may also be used in a 'horizontal' or other orientation, eg as a simple clamp or a haulage attachment, it will immediately be appreciated that unless otherwise clear in the context, such reference terms, also when these appear in the appended claims, are not to be regarded as limiting of the scope of the invention.

A lifting clamp of the type with which the present invention is concerned is known from U.S. Pat. No. 5,893,595 (Corbett). The Corbett lifting clamp includes a rigid frame comprising vertical, parallel spaced-apart side plates, the upper ends of which are rigidly secured together by four tubular cross-members. The lower portion of one of the side plates is angled away in downward orientation from the other side plate, the latter providing a fixed clamping jaw of the device. A vertically extending plate is mounted for horizontal sliding movement on the cross-members between the side plates and provides a movable jaw of the device. An actuator carriage which is disposed for guided vertical up and down movement, is located between the movable jaw and the lower, angled portion of the frame side plate, whereby different sets of rollers of the carriage respectively engage the facing surfaces of the movable jaw plate and the angled portion of the frame side plate. A lifting cable or chain is attachable to an extension lug at the carriage. In order to lift (or otherwise handle and clamp) sheet material, the device is placed over the upper edge of the sheet so that it is received between the fixed and movable jaw plates, the carriage is raised by lifting the strip member through pulling the lifting cable upwards, whereby the carriage travels on the angled frame side plate portion and displaces the movable jaw horizontally until it abuts on the facing surface of the sheet material. Upon increasing the upward pulling force, the sheet material is frictionally clamped for it to be lifted with the device.

In essence, clamping of the sheet material between the plate jaws is achieved by wedging the carriage between the frame side plate and the movable jaw, and the clamping force is maintained for as long as there is upward force being on the lifting cable.

Other types of clamps or grapples that employ the principle of a wedge/clamping element being used to impart movement to a clamping member are known for example from U.S. Pat. No. 2,387,408, U.S. Pat. No. 3,197,250 and U.S. Pat. No. 3,524,670.

One disadvantage of the Corbett clamp is that gripping force application unto an uneven sheet, or sheets which do not have properly parallel faces, is compromised. This stems from the fact that the movable clamp jaw is restricted in its degrees of freedom of movement to horizontal sliding movement only along the lower guide rails that rigidly join the frame sides together. The vertically depending jaw is unable to adjust itself into full plane-parallel contact with divergent sheet faces. This results in a reduced clamp engagement surface with the sheet and potential slippage problems on lifting. Equally, the reduced engagement surface area means higher and uneven pressure distribution, with resultant load concentration that can lead to sheet edge breakage or shattering of the sheets upon lifting.

One object of the present invention is to provide an improved lifting device of the aforementioned type which provides for an improved engagement of the clamping jaw surfaces with uneven-faced sheet material or other objects to be lifted.

SUMMARY OF THE INVENTION

In accordance with one aspect of the invention there is provided a clamping device suitable for lifting and handling of sheet like-objects, having a rigid frame configured to straddle an edge region of sheet-like objects, the frame including a stationary jaw and a frame housing part defining a gap between them in which the sheet-like object may be received, the stationary jaw providing a first clamping surface, a movable jaw supported at the frame within the gap for movement towards and away from the stationary jaw, the movable jaw providing a second clamping surface, and an actuating carriage arranged to transmit a clamping force, the carriage being located between the movable jaw and frame housing part for reciprocating movement along a longitudinal axis of the device on actuator tracks present at the movable jaw and frame housing part, at least a portion of one of the actuator tracks having an inclined portion devised to bias the movable jaw towards the stationary jaw as the actuator carriage is caused by the clamping force to be displaced along the inclined portion, whereby the respective clamping surfaces are brought in contact with opposite faces of the sheet-like object when received within the frame and frictionally clamp same against displacement, characterized in that the movable jaw is supported at and mounted to the frame by at least one linkage arm which is articulated or pivoted at the movable jaw and near the upper end of the frame, respectively.

The above noted characterizing features introduce additional degrees of freedom of movement for the movable jaw, as compared to the mounting method employed by Corbett, without compromising safe and secure support of the movable jaw at the clamp's frame. Such mounting arrangement has the advantage that it enables the movable jaw to adjust its orientational attitude as it engages the sheet material that is to be clamped, thereby facilitating creation of a larger contact area between jaw member clamping surface and sheet face without compromising clamping force application. A further advantage is given by the articulated (2 degrees of rotational freedom of movement) or pivoted (1 degree of rotational freedom of movement) support of the movable jaw at the frame in that it substantially precludes generation of bending moments at or such moments from being transferred into the mount of the movable jaw at the rigid frame. Such moments may arise in a support configuration similar to that of Corbett, given that there clamping force application by the actuator carriage, as it is displaced upwardly, is effected at locations distant from the mounting area of the movable jaw at the traversal frame connection rods.

A rugged and sturdy construction of the frame may advantageously provided by the stationary jaw being of substantially rectangular plate-like configuration, the frame housing part being of rectangular, box-like configuration such as to provide an open-sided recess suitable for receiving the actuator carriage, and by the stationary jaw and frame housing part being rigidly secured to one another, in spaced-apart relationship, at their upper ends by preferably tubular cross-members. Equally, the movable jaw in a preferred embodiment is of rectangular, plate-like configuration and sized such as to remain within a front plan view footprint of the frame housing member.

It is preferred to have one pair of said linkage arms in spaced parallel relationship mount the movable jaw to the frame housing part of the frame. The use of two linkage arms instead of a single piece embodiment permits locating the carriage between the arms along a central longitudinal axis of the frame, thereby facilitating carriage movement and avoiding out-of-center force application during clamping.

The length of the linkage arms and the location where these are connected to the movable jaw member, eg near an upper end, at a middle section or near a lower end, as well as the angle of inclination and length of the inclined portion(s) of the actuator tracks will determine the maximum thickness of sheet-like objects that may be securely clamped and lifted with the clamping device in a hoisting operation, and may be chosen accordingly.

In order to allow greatest possible flexibility with regards to clamping and lifting of sheet materials having different thicknesses, an arrangement is preferred wherein the linkage arms are pivoted near a lower end of the movable jaw, i.e. a location remote from where the arms are pivoted to the frame housing part. Nonetheless, short linkage arm embodiments are also useful, in which case pivoted support of the movable jaw member at the frame housing part can be effected near an upper end of the movable jaw.

In one embodiment of the invention's clamping device, the inclined actuator track portion(s) will be present either only on the movable jaw or only the frame housing part, preferably on the movable jaw member. Dedicated parts may be provided to form these tracks, either mounted to the movable jaw and/or frame housing part, or made integral therewith. For example, in an embodiment where the frame housing part is a box-like, cast body, the open-sided cavity may have a planar floor which provides a smooth surface on which one or more actuator carriage rollers rest and roll within the housing part. Similarly, two ramp blocks may be provided on the plate-like movable jaw, contoured to provide the track paths, a second set of actuator carriage rollers engaging the strip-like surfaces of the ramp blocks that face the housing part cavity.

In a preferred embodiment, however, first inclined actuator track portion(s) will be present on the movable jaw and second inclined actuator track portion(s) will be present on the frame housing part, either in complementary or sequential arrangement; a complementary arrangement is a configuration wherein the inclined track portions are located relative to one another such that the actuator carriage moves simultaneously along the inclined track portions that are present on both clamp parts, whereas a sequential arrangement is one in which the carriage moves first along an inclined track portion on one of the clamp parts and then on an inclined track portion that is present on the other one of the clamp parts.

In a preferred configuration, the first inclined (actuator carriage) track portion(s) present at the movable jaw member, commence(s) at or near a lower end of the jaw member and is (are) inclined towards an upper end of the frame housing part before merging into an essentially vertically extending track portion(s), whereas the (actuator carriage) track that is present at the frame housing part includes an essentially vertical portion which commences at a lower end of the frame member and then merges into a second inclined track portion that is inclined towards an upper end of the movable jaw part, i.e the first and second inclined track portions are inclined in opposite directions and notionally converge towards the upper end of the frame, and wherein the respective track portions are disposed preferably in sequential arrangement.

The immediately aforementioned preferred configuration is particularly advantageous in combination with one where the link arms are pivoted at the movable jaw near a lower portion thereof, for example at the ramp block sides. With such arrangement, as the actuator carriage travels upwards from its lowest most rest position along the first inclined track portion at the movable jaw, the bottom edge of the movable jaw will tend to be rotated towards the stationary jaw and into engagement with sheet-like material received in the clamp, and the movable jaw will also shift horizontally and upwardly as a whole towards the stationary jaw to achieve planar abutment of the clamping surface onto the sheet material; where sheet material thickness prevents further travelling upwards of the actuator carriage, secure clamping is achieved upon hoisting the entire clamping device, the clamping force being equal to the weight of the clamping device and the sheet material. With thinner sheet material, the actuator carriage will reach the vertically extending track portion of the movable jaw before clamping is effected, and then be shifted in a direction towards the stationary jaw as it travels along the inclined track portion of the housing frame member, thereby seeking to impart rotational motion to the upper edge of the movable jaw towards the stationary jaw and ultimately bring the movable jaw's clamping surface into planar abutting relationship with the sheet material. Again, safe clamping and subsequent hoisting of thinner sheet material is ensured.

It will be appreciated that more than one inclined track portion may be present on either one or both of the movable jaw and housing frame member, that the angles of inclination of the track portions may vary and be dissimilar to one another, and that the inclined track portions may be continuous or interrupted by vertical track portions.

Equally, embodiments of the invention contemplate the use of curved 'inclined' track portions, rather than rectilinear or straight inclined actuator carriage track portions, wherein the curvature may be chosen to achieve a desired progressive or decreasing carriage displacement or movement away from the housing frame member as it travels from a first rest position, where the clamping surfaces are spaced-apart, to a second rest position, where the carriage is 'wedged' between the movable jaw and housing frame parts and the clamping surfaces of the movable jaw and stationary jaw are pressured against the respectively facing (opposite) surfaces of the sheet-like object.

As noted at the outset above, the terms 'upper', 'lower', 'vertical' and similar have been used in the above description of preferred forms and features of embodiments of the invention solely to facilitate understanding of relative location and orientation of components of the clamping device. Use of these terms presuppose that the clamping device is orientated with its longitudinal axis in an upright or vertical direction as would be the case when the clamp is used for hoisting slab or sheet material, and clamping force is transmitted through the actuator carriage, which is preferably connected to or carried by a tension member that is connectable to a hoisting device such as a cable, as it is moved in an upward direction. Given that the clamping device may be used in other applications where the device's longitudinal axis, in use, does not coincide with vertical, the relative, spatial reference terms may be transformed accordingly.

A preferred embodiment of a clamping device, as used for lifting slab materials, in accordance with the present invention, and further features and advantages of the invention, will be described with reference to the accompanying drawings.

DESCRIPTION OF PREFERRED EMBODIMENTS

Figure 1:
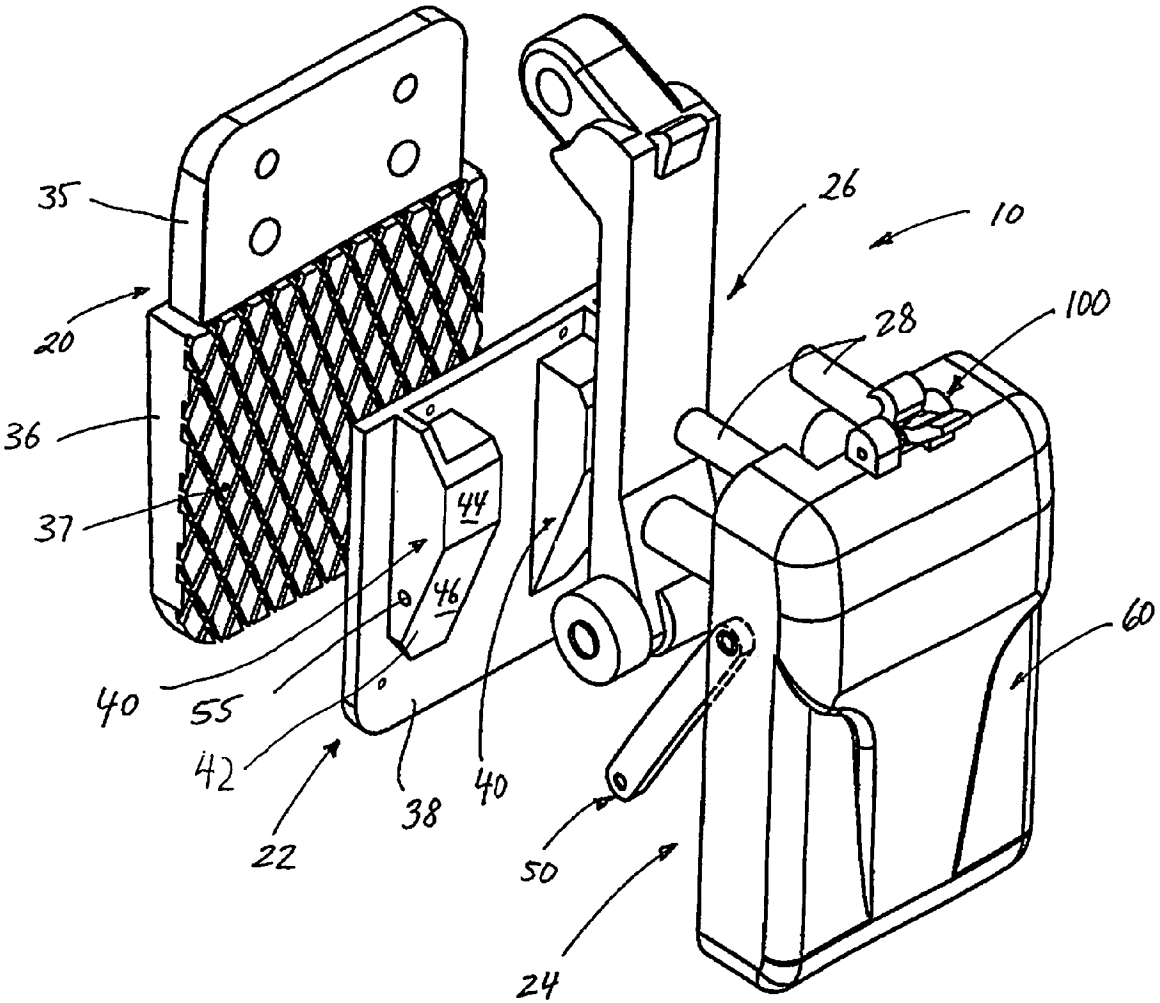
FIG. 1 is an isometric, disassembled view of clamping device for hoisting slab materials in accordance with a first embodiment of the invention, showing its main subassemblies.

In the following description, reference terms such as 'upper', 'lower', 'vertical', 'horizontal', 'left' and 'right' are chosen with regard to the drawing plane of the relevant figures and to aid in referencing clamp components with respect to one another.

Figure 2:
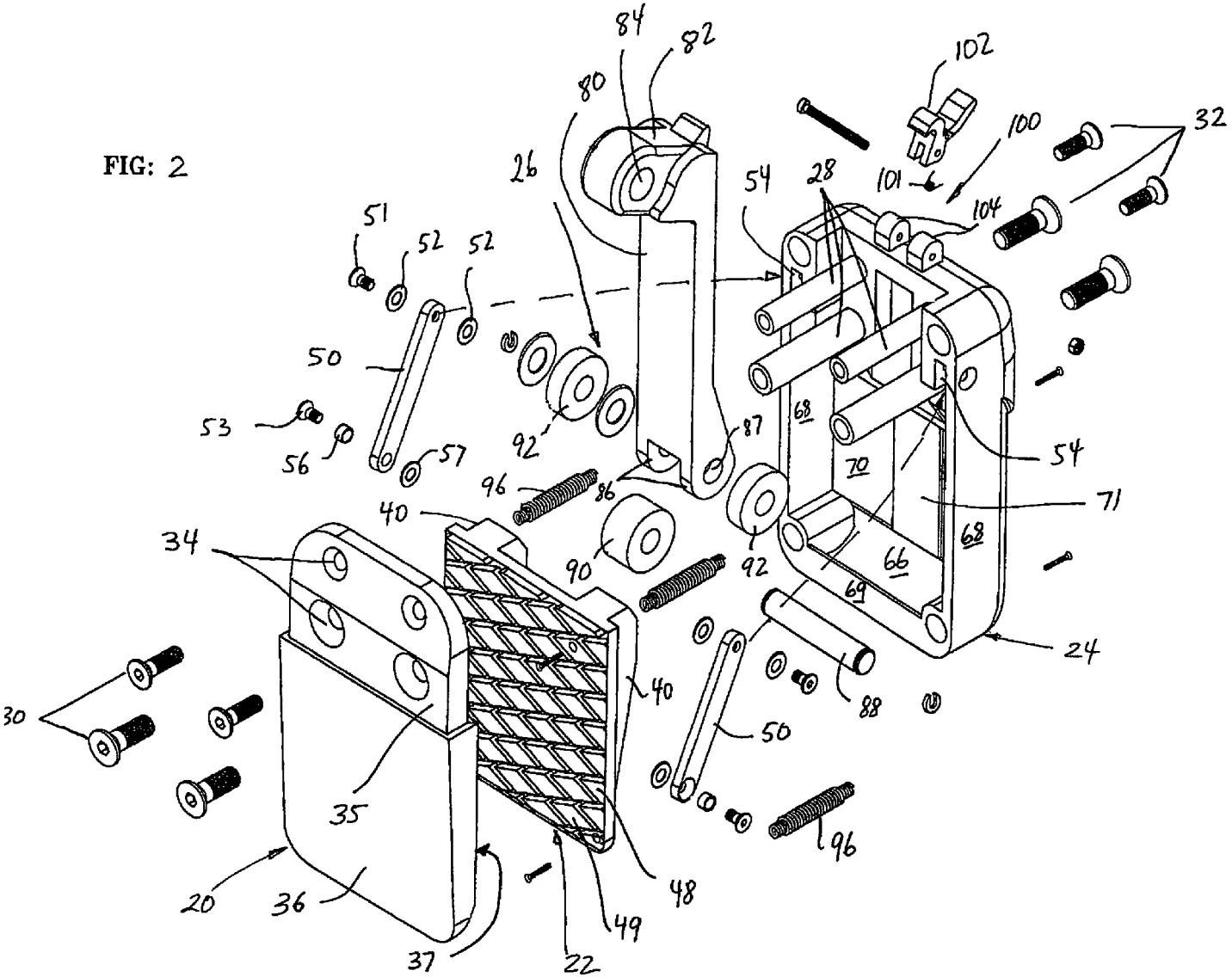
FIG. 2 is an isometric view of the clamping device of FIG. 1, from an opposite side perspective and showing the component parts of the subassemblies of the clamp.

Referring first to FIGS. 1 and 2, there is shown a clamping device 10 in accordance with a preferred embodiment of the present invention as devised for lifting and hoisting sheet-like materials of substantial planar dimensions and weight. The expression "sheet materials" is here generically used to describe slabs of stone, marble, sheet or sheets of metal tightly bundled into a stack, or the like.

Figures 3A, 3B, 3C:
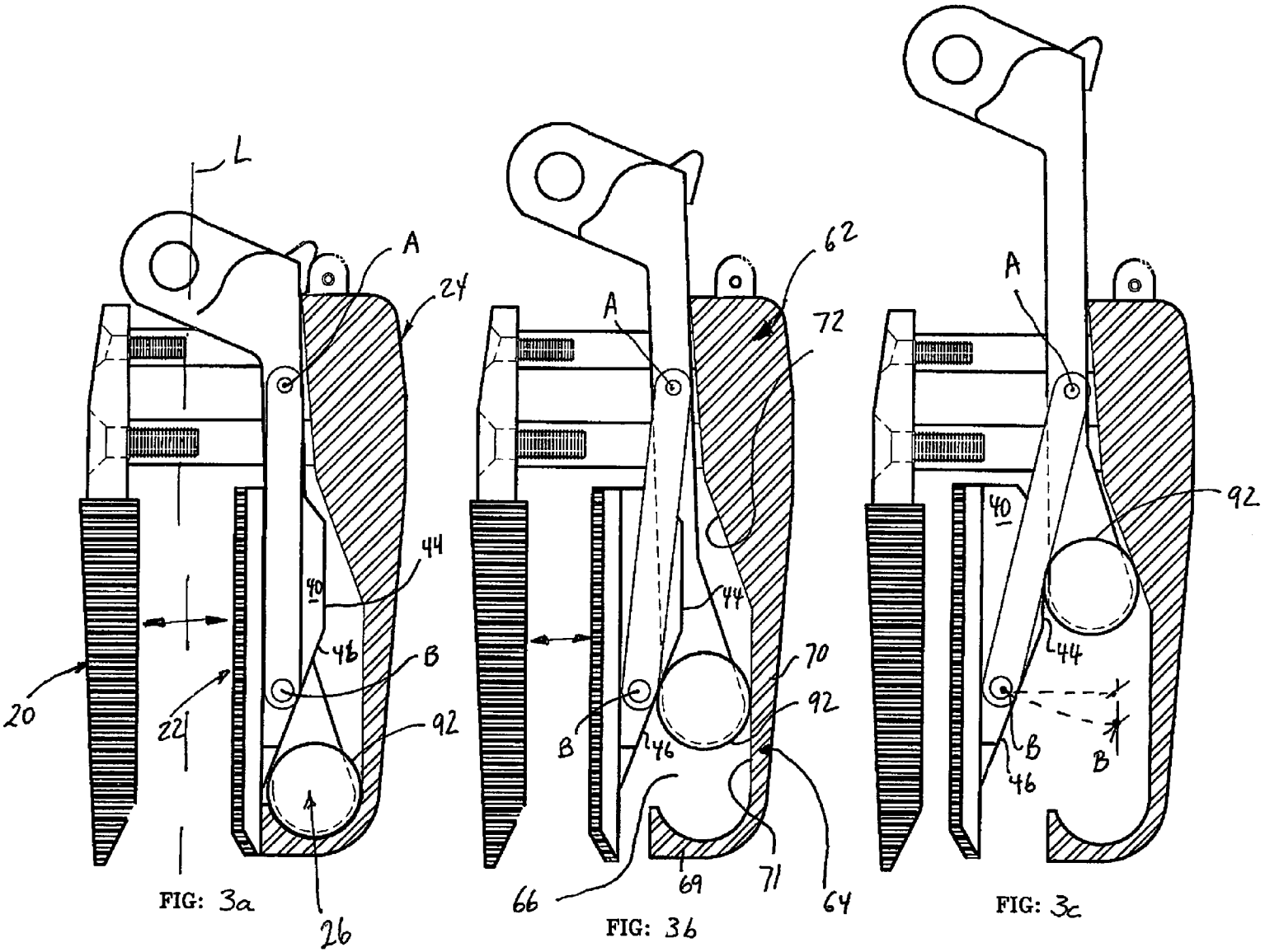
FIGS. 3*a* to 3*c* are schematic and simplified longitudinal sections of the clamping device of FIG. 1, illustrating operation of the clamp from a rest position to two different engaged positions.

The lifting clamp 10, shown schematically also in longitudinal section in FIGS. 3*a* to 3*c*, comprises essentially four subassemblies or components, a stationary jaw 20, a movable jaw 22, a housing frame assembly 24, and an actuator carriage assembly 26. The latter serves to move the movable jaw part 22 with respect to the stationary jaw 20 and housing assembly 24 in between which the movable jaw 22 is received, and to apply a clamping force to retain sheet material (not shown) securely clamped between the fixed and movable jaws 20 and 22 within the device 10

Stationary jaw part 20 and housing part 24 define a rigid clamp frame and are joined together at an upper end in spaced-apart relationship by means of two pairs of parallel tubular cross bars 28 which have terminal ends that are secured by screws 30 in receptacle bores (not shown) at the housing member 24 and whose opposite terminal ends are rigidly fixed to stationary jaw part 20 using screws 32 that extend through bores 34 as is evident from FIG. 2 and FIG. 3.

Stationary jaw part 20 is comprised of a substantially rectangular steel plate 35 with the four bores 34 disposed at an upper end. A rubber covering 36 is fitted to the lower portion of steel plate 35, and has a trapezoidal cross-section with a lower portion that is angled slightly inwardly to allow for easy manoeuvring of the jaw part 20 over the slab and minimising risk of edge breakage. Covering 36 provides a high friction material clamping surface 37 at stationary jaw 20 against which the sheet material to be clamped will be pressed during lifting, to prevent the sheet from slipping or being damaged during lifting operation.

The movable jaw part 22 consists of a generally rectangular steel plate 38, carrying on one surface a pair of steel ramp blocks 40 that are spaced-apart across the width of plate 38. The steel ramp blocks 40 are welded or otherwise fastened to plate 38, but may also be integrally cast with the plate 38. These ramp blocks 40 define a contoured track surface 42 the purpose of which is described below. On the surface opposite that on which blocks 40 are carried, a rubber material or other high friction pad 48 is secured (eg by gluing) to plate 38, thus providing a second clamping surface 49 for engagement with the sheet material during lifting operations which minimises slippage risk during hoisting.

A pair of link arms 50 serve to mount and pivot the movable jaw 22 to the housing frame part 24 which is described in greater detail below. The upper terminal ends of link arms 50 are secured by way of mounting screws 51 and washers 52 into respective mounting recesses 54 provided at width-wise opposite sides in an upper portion of the housing frame part 24 (see FIG. 2) to allow rotational movement of the arms about an axis A that extends traverse to longitudinal axis L of the device 10. The lower terminal ends of link arms 50 are secured by way of mounting screws 53 and washers 54 to the width-wise outward facing side of the ramp blocks 40, which to this end are provided at a lower end with threaded mounting bores 55, see FIG. 1. Sleeves or bushes 56 ensure that movable jaw 22 is free to pivot about an axis B that extends traverse to longitudinal axis L of the device 10.

The link arm mounting arrangement chosen enables the movable jaw 22 as a whole to be displaced towards and away from the stationary jaw 20 as well as housing frame part 24, the length of the arms ensuring that pivot axis B performs only a shallow arcuate path about pivot axis A that causes the lower terminal edge of movable jaw 22 to move slightly vertically up and down during such pivoting, as well as enabling the movable jaw 22 itself to pivot about axis B. The latter enables the clamping surface 49 of movable jaw 22 to cater for lack of complete parallel arrangement of the surfaces of sheet material to be clamped between the movable and stationary jaws 22 and 20.

As best seen in FIG. 2, housing frame 24 includes a substantially rectangular parallelepiped shaped housing box part 60, which has a solid material upper portion 62 and a lower portion 64. The upper portion 62 has formed therein four bores of stepped diameter that serve to form-fittingly receive the terminal ends of cross rods 28 and secure same against displacement therein using screws 32. Lower portion 64 includes an open cavity 66 bordered by opposing widthwise disposed side walls 68, a lower-end bottom wall 69, a planar base wall 70 and said upper solid material portion 62. An inclined surface 72 sloping towards the upper end of frame part 24 defines the transition between the vertical inner surface 71 of planar base wall 70 and upper portion 62, as is best seen in FIGS. 3*a* to 3*c*. As noted above, recesses 54 are formed in the solid material portion 62 for receiving and securing the upper ends of linkage arms 50.

Carriage assembly 26 includes a vertically extending metal strip bar 80 carrying at its upper terminal end a connection ear or lug 82 with an eye 84 that is adapted to receive a hook or shackle or directly a tension cable by way of which the entire device 10 may be lifted and the clamping action effected. At its lower end, strip bar 82 is bifurcated and defines two mounting flanges 86 which serve to secure a roller axle 88 which in turn carries a first roller 90 that is located between the mounting flanges 86, and a pair of follower rollers 92 disposed at axially opposite ends of the axle 88 outside the respectively adjoining flanges 86. Axle 88 is secured in known manner against removal from its mounting at flanges 86. Rollers 90 and 92 define together with the lower part of bar 80 an actuator carriage that serves the purpose of displacing/moving movable jaw 22 in relation to the two stationary frame parts 20 and 24. Strip bar 80 is of a width that enables close but friction-free guidance thereof between the traverse cross-member pairs during upward and downward movement thereof.

It will be appreciated by the skilled worker that when the clamping device 10 is suspended from lug 82, the entire actuator carriage assembly 26 will wish to move in upward direction, whereby the central roller 90 will be maintained in engagement with and roll up first along the vertical inner surface 71 and then along the inclined upper surface 72; these surfaces 71, 72 thus provide track segments which the central carriage roller 90 will follow. Equally, during upward movement, the lateral follower rollers 92 will be in engagement with the contoured track surface 42, which includes a vertical and an inclined portions 44 and 46, at the ramp blocks 40 and follow the contour path provided thereby, ie impart on the movable jaw 24 a vertical and horizontal movement at first.

To secure the actuator carriage assembly 26 in the lower most, inoperative position, a simple locking device 100 is provided, consisting of a spring-loaded hook lever 102 pivoted between pedestal supports 104 formed or fastened at the outside upper end of frame housing part 24.

Figure 4:
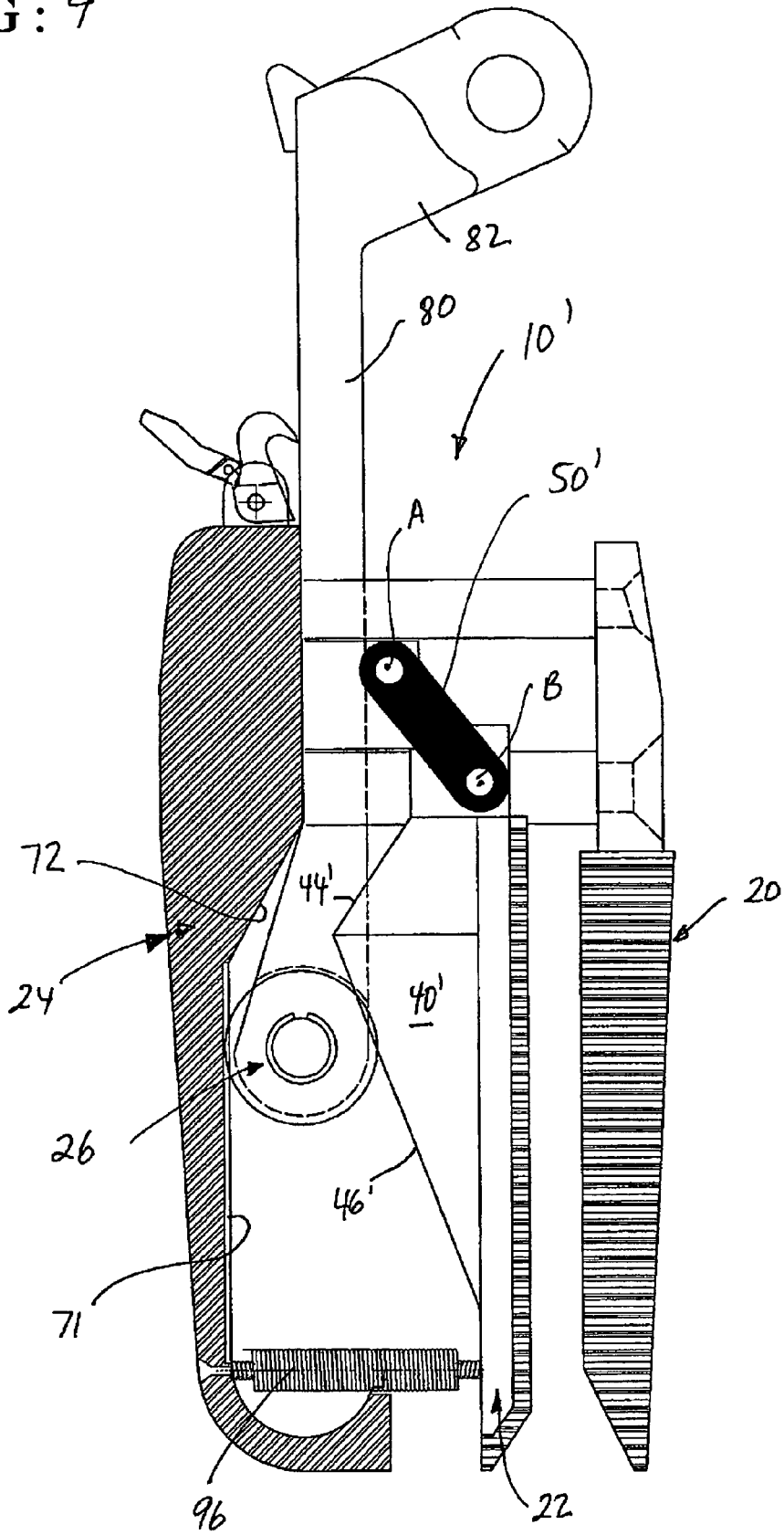
FIG. 4 is a schematic and simplified longitudinal section similar to FIG. 3*a* of a further embodiment of a hoisting clamping device in accordance with the invention.

Finally, as best seen in FIGS. 2 and 4, a set of four tension springs 96 are located between the movable jaw plate 48 and the housing box part 60 such as to bias the movable jaw 22 towards the frame housing 24 and cover cavity 66. This position represents the fully open clamp jaws position, and depending on the spring constants of the tension springs employed, an additional locking member, not illustrated, may be required to secure the open position. For symmetry reasons, four tension springs are used, located and secured in appropriate manner using screws 97 at the respective corners of movable jaw plate 48 and housing box part 60.

A slightly modified embodiment of such lifting clamp 10' is shown in FIG. 4. The main difference in comparison to the embodiment illustrated in FIGS. 1 to 3 resides in the shortened linkage arms 50', the consequential need for pivoting these near an upper portion of the movable jaw plate 38 instead of at a middle or lower part, as well as a modified track profile 44' and 46' at the ramp blocks 40', in that two inclined track surface portions are provided instead of one inclined 46 and one vertically 44 extending section as seen in FIGS. 3*a* to 3*c* in particular. The clamp 10' of FIG. 4 has a smaller jaw opening width capability, and is thus more suited for clamping and lifting thicker sheet materials.

Operation of the clamp device will now be described with reference to FIGS. 3*a* to 3*c*. As noted above, the entire device 10 may be hoisted through use of a suitable hoisting cable that is secured to lug 82 at the upper terminal end of the carriage assembly's pull rod (bar) 80. The lifting force exerted by the hoisting cable will cause actuator carriage 26 move upwards, and in absence of any sheet material being received between movable jaw 22 and stationary jaw 20 move from the rest position illustrated in FIG. 3*a* at the bottom of the housing frame cavity 66 into a position past the one illustrated in FIG. 3*c*, where the clamping surfaces 37 and 49 of the jaw members 20 and 22 may come into abutting stop. As noted above, locking mechanism 100 may be employed in order to arrest upward movement of actuator carriage 26 with respect to housing part 24, so that the lifting clamp 10 may be hoisted in its non-operational rest position.

During upward movement of carriage 26, its follower rolls 92 will roll on the track surfaces 46 and 44 defined at ramp blocks 40, without coming into engagement with the inner surface 71 of the bottom wall 71 of frame housing part 24. Rather, the central roller 90 (which is not visible in FIGS. 3*a*–*c*) will perform guidance and reaction of the actuator carriage 26 at the stationary frame housing 24 as it rolls first along vertical section 71 and then inclined track section 72. During upward movement of carriage 26, pivot axis B, at which the movable jaw 22 is supported on the linkage arms 50, will move slightly upwards and be displaced in horizontal direction towards the stationary jaw part 20, as schematically indicated in FIG. 3*c*. All along such movement pattern, the movable jaw 22 may freely pivot about axis B unless otherwise restrained from doing so, eg by a sheet material received in the gap between jaw members 20 and 22. The parallel arrangement of linkage arm pivot axis A and B enables the movable jaw plate to maintain an upright orientation parallel with the longitudinal axis L of the device 10, and if required attain an inclined orientation to adapt to a non plane-parallel surfaced sheet material, eg where there is a slight taper in the sheet thickness.

It will be appreciated that the specific geometries, dimensions and relative spacing of linkage pivot axes A and B, linkage arms, angle of inclination of the inclined tracking surfaces 46, 72 for the actuator carriage rollers 90 and 92 and other components that define the specific kinematics of movement of the movable jaw member 22 may be varied to suit requirements.

Of course, modifications such as the profile shape of the track surface for the actuator carriage, number and location of ramp blocks, the number and locations of the tension springs, the size and cross-sectional shape of the cross bars, the material of the various components of the lifting device to form a light weight, yet strong clamping lifting device that will withstand heavy duty use, etc. are all within the scope contemplated by the disclosed invention.

The invention claimed is:

1. Clamping device suitable for lifting and handling of sheet like-objects, comprising:

a rigid frame configured to straddle an edge region of sheet-like objects, the frame including a stationary jaw and a frame housing defining a gap between the stationary jaw and the frame housing in which the sheet-like object may be received, the stationary jaw providing a first clamping surface;

a movable jaw supported at the frame within the gap for movement towards and away from the stationary jaw, the movable jaw providing a second clamping surface;

at least one linkage arm pivotably mounted to the rigid frame for supporting the movable jaw such that the movable jaw is movable in an arc relative to the rigid frame;

an actuating carriage arranged to receive a lifting force and to transmit a clamping force, the carriage being located between the movable jaw and the frame housing for reciprocating movement along a longitudinal axis;

actuator tracks for the actuating carriage provided on the movable jaw and on the frame housing, the actuator tracks having an inclined portion relative to the longitudinal axis which, when the actuator carriage is caused by the lifting force to be raised along the inclined portion, causes biasing movement of the movable jaw toward the stationary jaw through pivoting movement of the linkage arm;

whereby, when the clamping device straddles the sheet-like object and the lifting force is applied, the lifting force brings the first clamping surface and the second clamping surface in contact with opposite faces of the sheet-like object, thereby frictionally clamping the sheet-like object.

2. Clamping device according to claim 1, wherein the stationary jaw is a substantially rectangular plate, wherein the frame housing is of rectangular, box-like configuration such as to provide an open-sided recess suitable for receiving a portion of the actuator carriage, and wherein the stationary jaw and frame housing are rigidly secured to one another, in spaced-apart relationship, at their upper ends by cross-members.

3. Clamping device according to claim 2, wherein the frame housing defines a plan view footprint when viewed along a line of sight perpendicular to the clamping surface of the stationary jaw, wherein the movable jaw is a substantially rectangular plate sized to remain within the plan view footprint of the frame housing.

4. Clamping device according to claim 1, wherein the at least one linkage arm comprises a pair of linkage arms in spaced parallel relationship which mount the movable jaw to the frame housing.

5. Clamping device according to claim 1, wherein the linkage arm pivotably attaches at an upper end to the frame housing, and pivotably attaches at a lower end to the movable jaw.

6. Clamping device according to claim 1, wherein the linkage arm pivotably attaches to the rigid frame near an upper end of the movable jaw.

7. Clamping device according to claim 1, wherein the inclined portion of the actuator track is on the movable jaw.

8. Clamping device according to claim 7, wherein the actuator track on the movable jaw made integral with the movable jaw.

9. Clamping device according to claim 1, wherein the inclined portion of the actuator tracks comprises an inclined portion on the movable jaw and an inclined portion on the frame housing.

10. Clamping device according to claim 9, wherein the inclined portion of the actuator track on the movable jaw is lower than the inclined portion of the actuator track on the frame housing.

11. Clamping device according to claim 10, wherein the inclined portion of the actuator track on the movable jaw commences near a lower end of the movable jaw and is inclined towards an upper end of the frame housing before merging into an essentially vertically extending track portion, wherein the actuator track on the frame housing includes an essentially vertical portion which commences at a lower end of the frame housing and then merges into the inclined portion of the actuator track on the frame housing, with the inclined portion of the actuator track on the frame housing being inclined towards an upper end of the movable jaw.

12. Clamping device according to claim 11, wherein the linkage arm permits a bottom edge of the movable jaw to be moved a greater distance towards the stationary jaw than a top edge of the movable jaw is moved towards the stationary jaw.

13. A clamping device suitable for lifting and handling of objects, comprising:

an actuating carriage for receiving a vertical lifting force, the actuating carriage including a force transfer member for providing a force having at least a horizontal component;

a rigid frame comprising:

a stationary jaw on a first side of the force transfer member of the actuating carriage, the stationary jaw having a first clamping surface facing toward the force transfer member; and a member having a first contact surface for the force transfer member, the first contact surface being disposed on a second, opposing side of the force transfer member; and a movable jaw disposed between the force transfer member of the actuating carriage and the stationary jaw of the rigid frame, the movable jaw having a second clamping surface facing away from the force transfer member, the movable jaw comprising:

a second contact surface for the force transfer member disposed on the first side of the force transfer member;

wherein the first and second contact surfaces, when the actuator carriage is caused by the lifting force to be raised vertically, cause the force transfer member to place a force on the movable jaw having at least a horizontal component, thereby causing movement of the movable jaw away from the first contact surface and toward the stationary jaw;

wherein the movable jaw is mounted relative to the rigid frame such that the movable jaw can adopt an orientation of a side of the object being lifted which is at an angle to the lifting force, and such that the movable jaw can simultaneously adopt different spacing from the stationary jaw to lift objects of a range of different thicknesses via the vertical lifting force;

wherein the movable jaw is mounted to the rigid frame by a linkage arm which is pivotably attached to the rigid frame on one end and pivotably attached to the movable jaw at an opposing end, and wherein the force transfer member initially contacts the second contact surface at a location lower than the pivotable attachment of the movable jaw to the linkage arm;

whereby, when the clamping device straddles the object and the vertical lifting force is applied to the clamping device, the lifting force brings the first clamping surface and the second clamping surface in contact with opposite faces of the object thereby frictionally clamping the object.

14. The clamping device of claim 13, wherein the force transfer member comprises:

a first roller riding on the first contact surface, and a second roller riding on the second contact surface.

15. The clamping device of claim 13, wherein the first contact surface comprises an inclined portion angled upward and toward the stationary jaw, and wherein the second contact surface comprises an inclined portion angled upward and away from the stationary jaw.

* * * * *